US009309757B2

(12) United States Patent
Wright et al.

(10) Patent No.: US 9,309,757 B2
(45) Date of Patent: Apr. 12, 2016

(54) RADIO FREQUENCY ANTENNA ASSEMBLY FOR HYDROCARBON RESOURCE RECOVERY INCLUDING ADJUSTABLE SHORTING PLUG AND RELATED METHODS

(71) Applicant: Harris Corporation, Melbourne, FL (US)

(72) Inventors: Brian Wright, Indialantic, FL (US); Murray Hann, Malabar, FL (US); Raymond Hewit, Palm Bay, FL (US); Verlin A. Hibner, Melbourne Beach, FL (US)

(73) Assignee: HARRIS CORPORATION, Melbourne, FL (US)

( * ) Notice: Subject to any disclaimer, the term of this patent is extended or adjusted under 35 U.S.C. 154(b) by 429 days.

(21) Appl. No.: 13/772,975

(22) Filed: Feb. 21, 2013

(65) Prior Publication Data

US 2014/0231416 A1 Aug. 21, 2014

(51) Int. Cl.

| | |
|---|---|
| ***H05B 6/64*** | (2006.01) |
| ***E21B 36/00*** | (2006.01) |
| ***H01Q 21/12*** | (2006.01) |
| ***E21B 43/24*** | (2006.01) |

(52) U.S. Cl.

CPC ..... *E21B 43/2401* (2013.01)

(58) Field of Classification Search

CPC ..... E21B 43/2401

USPC ..... 166/57, 248, 302, 53, 60, 66, 250, 313, 166/50, 384; 219/679; 343/812, 792.5, 793, 343/814, 830, 831

See application file for complete search history.

(56) References Cited

U.S. PATENT DOCUMENTS

| | | | | |
|---|---|---|---|---|
| 2,632,795 | A * | 3/1953 | Boucher | 324/368 |
| 3,187,815 | A * | 6/1965 | Ownby | 166/63 |
| 4,754,812 | A * | 7/1988 | Gentry | E21B 33/1295 166/120 |
| 5,199,488 | A * | 4/1993 | Kasevich | B09C 1/062 166/248 |
| 6,053,248 | A * | 4/2000 | Ross | E21B 17/07 166/297 |
| 6,118,100 | A * | 9/2000 | Mailho | C23C 16/4584 118/728 |
| 7,298,345 | B2 | 11/2007 | Rankin | |
| 7,441,597 | B2 | 10/2008 | Kasevich | |
| 7,562,710 | B2 * | 7/2009 | Buchanan | 166/288 |
| 2003/0132006 | A1 * | 7/2003 | Bussear et al. | 166/386 |
| 2005/0178543 | A1 * | 8/2005 | Giacomino | 166/250.01 |
| 2009/0071652 | A1 * | 3/2009 | Vinegar | E21B 36/04 166/303 |
| 2009/0208295 | A1 * | 8/2009 | Kinert et al. | 405/224.2 |
| 2009/0242196 | A1 * | 10/2009 | Pao | 166/248 |
| 2010/0078163 | A1 | 4/2010 | Banerjee et al. | |
| 2010/0223011 | A1 * | 9/2010 | Parsche | G01V 3/30 702/11 |
| 2010/0294488 | A1 | 11/2010 | Wheeler et al. | |
| 2010/0294489 | A1 | 11/2010 | Dreher, Jr. et al. | |
| 2012/0048558 | A1 * | 3/2012 | Kumar | 166/308.1 |
| 2012/0125607 | A1 * | 5/2012 | Parsche | 166/272.1 |

* cited by examiner

*Primary Examiner* — Dana Ross
*Assistant Examiner* — Ket D Dang
(74) *Attorney, Agent, or Firm* — Allen, Dyer, Doppelt, Milbrath & Gilchrist, P.A.

(57) ABSTRACT

A radio frequency (RF) antenna assembly configured to be positioned within a wellbore in a subterranean formation for hydrocarbon resource recovery may include an RF transmission line and an RF antenna coupled to the RF transmission line. The RF antenna assembly may also include an adjustable balun that may include a tubular balun housing surrounding the RF transmission line and defining a space therebetween. The adjustable balun may further include an adjustable shorting body slidably movable within the space and contacting the tubular balun housing and the RF transmission line at an adjustable shorting position.

17 Claims, 6 Drawing Sheets

RADIO FREQUENCY ANTENNA ASSEMBLY FOR HYDROCARBON RESOURCE RECOVERY INCLUDING ADJUSTABLE SHORTING PLUG AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a largescale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna. These mismatches become particularly acute with increased heating of the subterranean formation. Moreover, such applications may require high power levels that result in relatively high transmission line temperatures that may result in transmission failures. This may also cause problems with thermal expansion as different materials may expand differently, which may render it difficult to maintain electrical and fluidic interconnections.

SUMMARY OF THE INVENTION

It is therefore an object of the invention to provide enhanced operating characteristics with RF heating for hydrocarbon resource recovery systems and related methods.

These and other objects, features, and advantages are provided by a radio frequency (RF) antenna assembly designed to be positioned within a wellbore in a subterranean formation for hydrocarbon resource recovery that includes an RF transmission line and an RF antenna coupled to the RF transmission line. The RF antenna assembly also includes an adjustable balun that includes a tubular balun housing surrounding the RF transmission line and defining a space therebetween. The adjustable balun further includes an adjustable shorting body slidably movable within the space and contacting the tubular balun housing and the RF transmission line at an adjustable shorting position. Accordingly, the balun may advantageously reduce common mode currents on the RF transmission line, for example, the an outer conductor of the RF transmission line, as the operating characteristics of the antenna change during the heating process to thereby provide enhanced efficiencies.

A method aspect is directed to a method of adjusting a balun for a radio frequency (RF) antenna assembly to be positioned within a wellbore in a subterranean formation for hydrocarbon resource recovery. The method include slidably moving an adjustable shorting plug within a space between a tubular balun housing surrounding an RF transmission line to be coupled to an antenna. The adjustable shorting plug contacts the tubular balun housing and the RF transmission line at an adjustable shorting position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
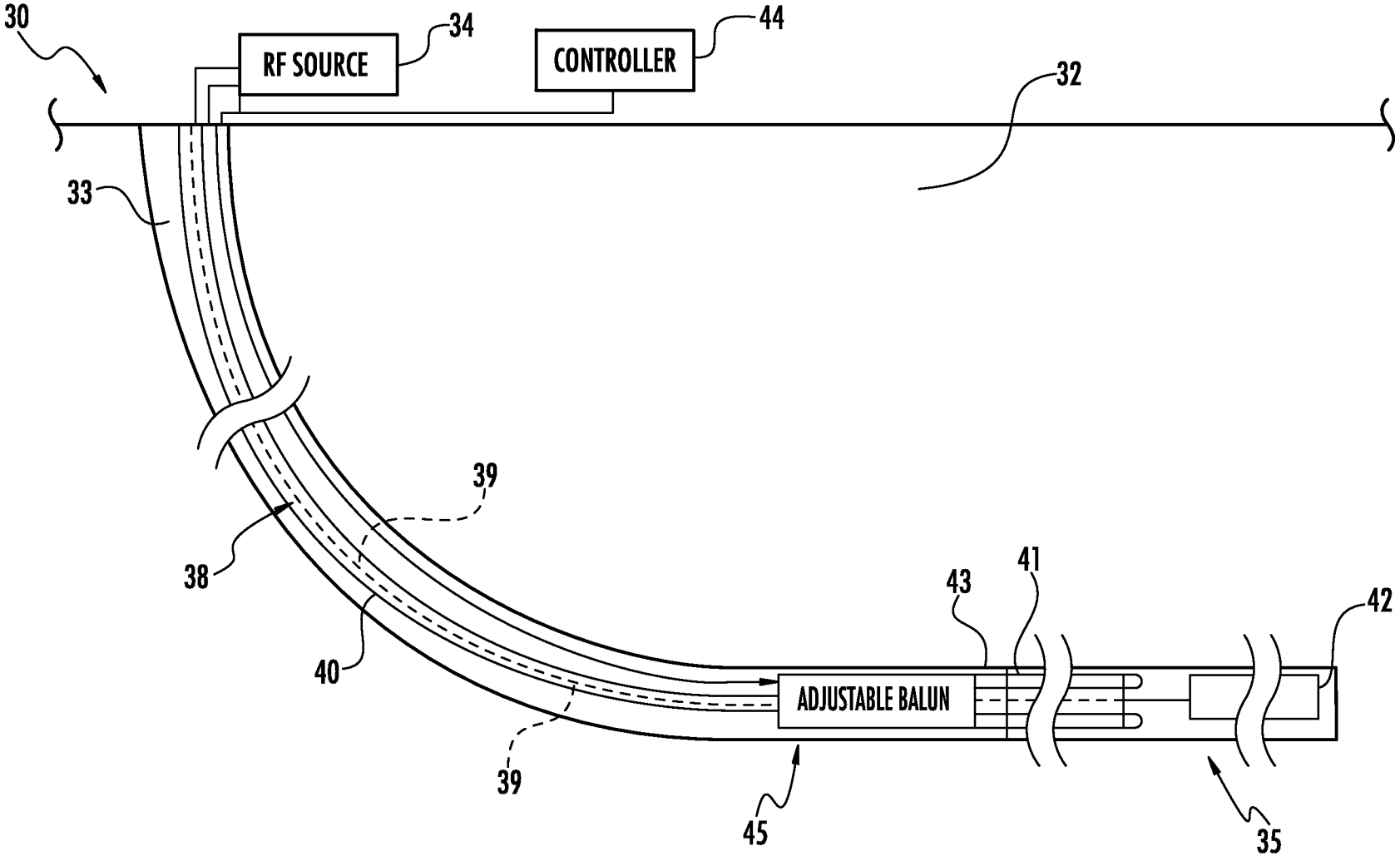
FIG. 1 is a schematic diagram of a subterranean formation including an RF antenna assembly in accordance with the present invention.
Figure 2:
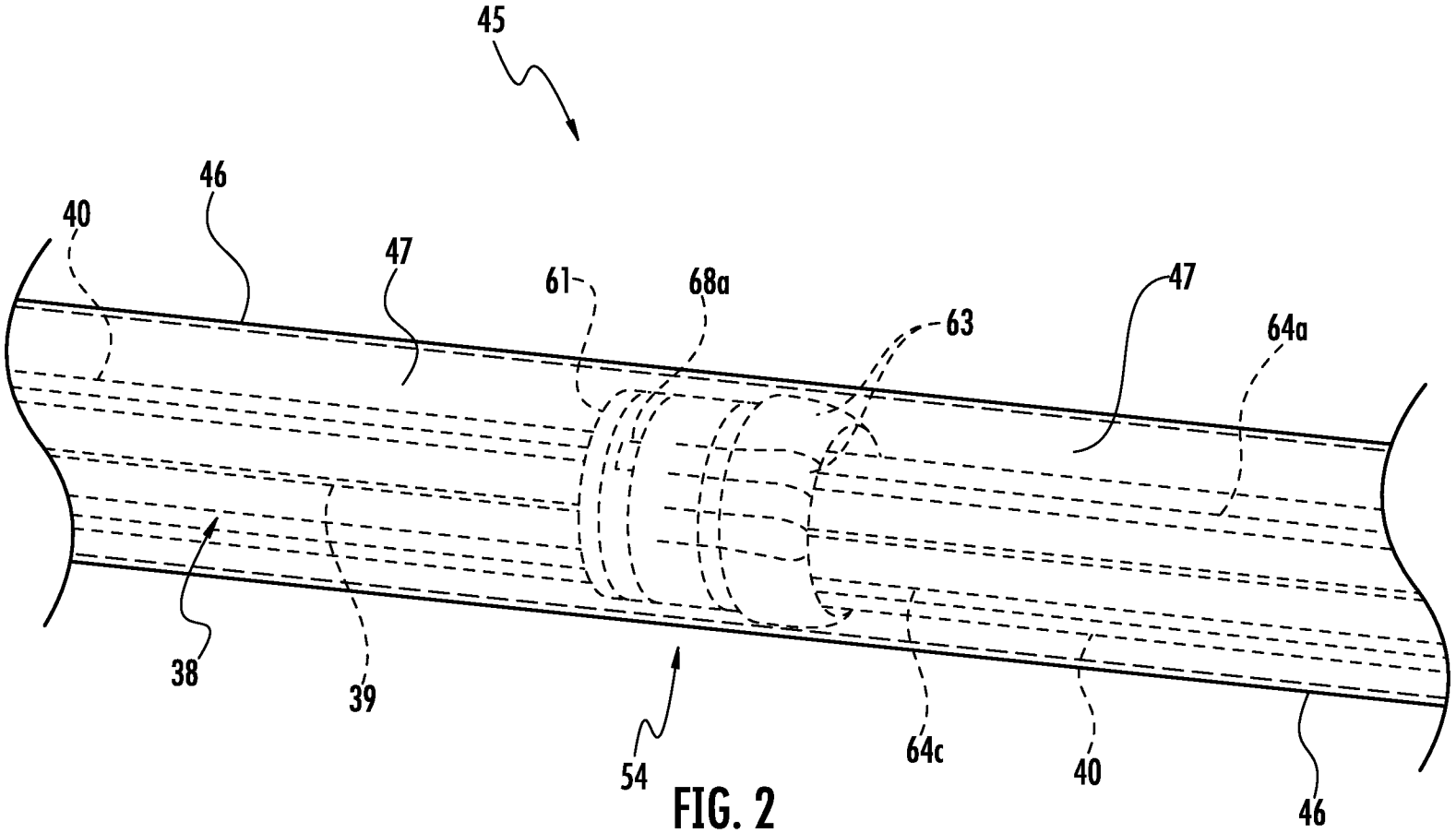
FIG. 2 is an enlarged perspective view of a portion of the adjustable balun of FIG. 1.
Figure 3:
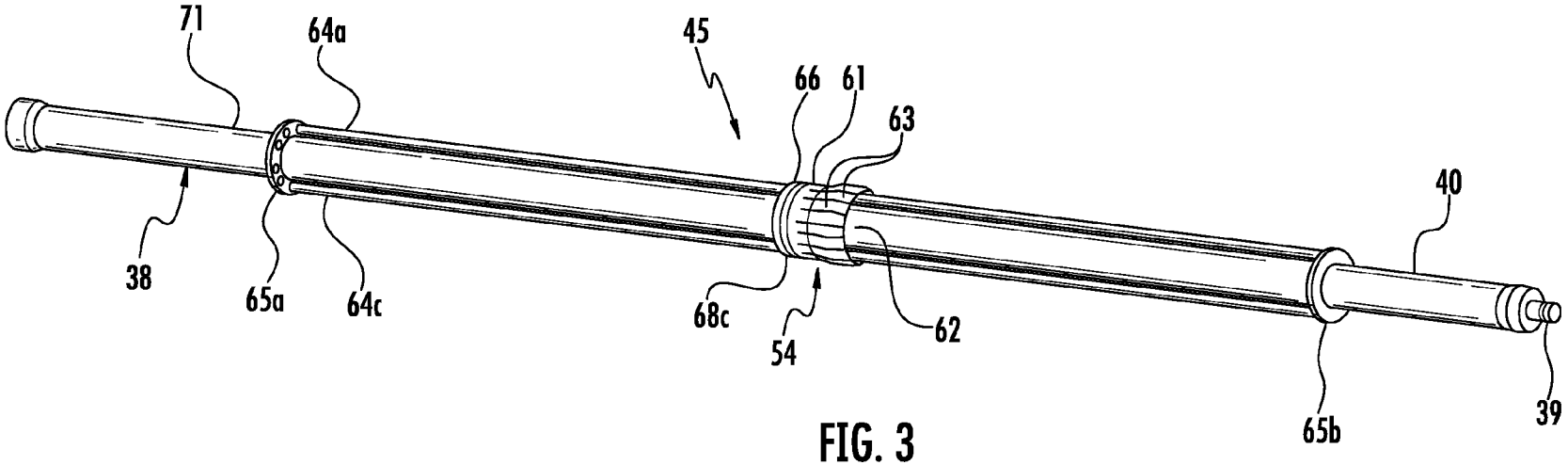
FIG. 3 is a perspective view of a portion of the RF transmission line and adjustable balun in accordance with the present invention with the tubular balun housing removed.
Figure 4:
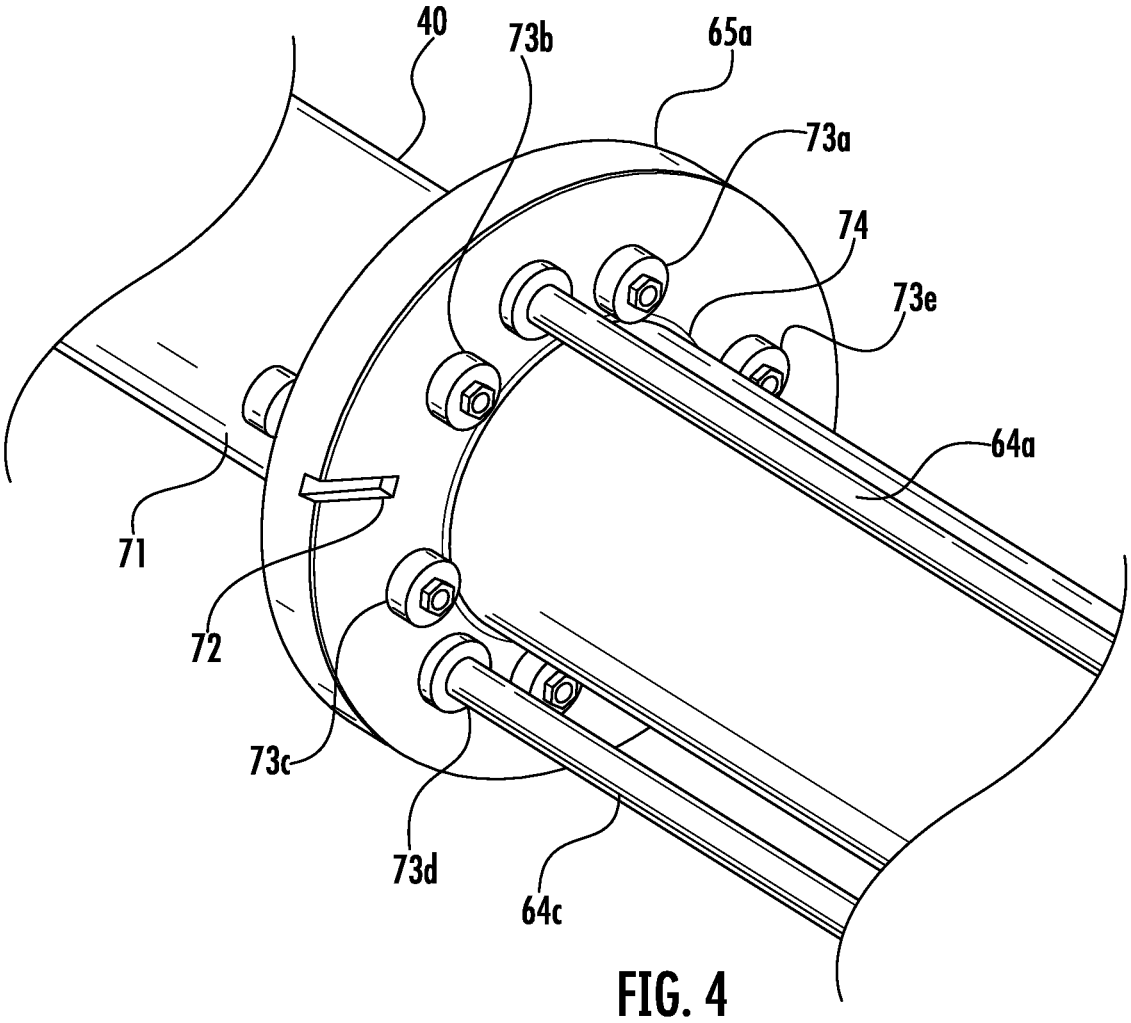
FIG. 4 is a greatly enlarged perspective view of a portion of the adjustable balun of FIG. 3.
Figure 5:
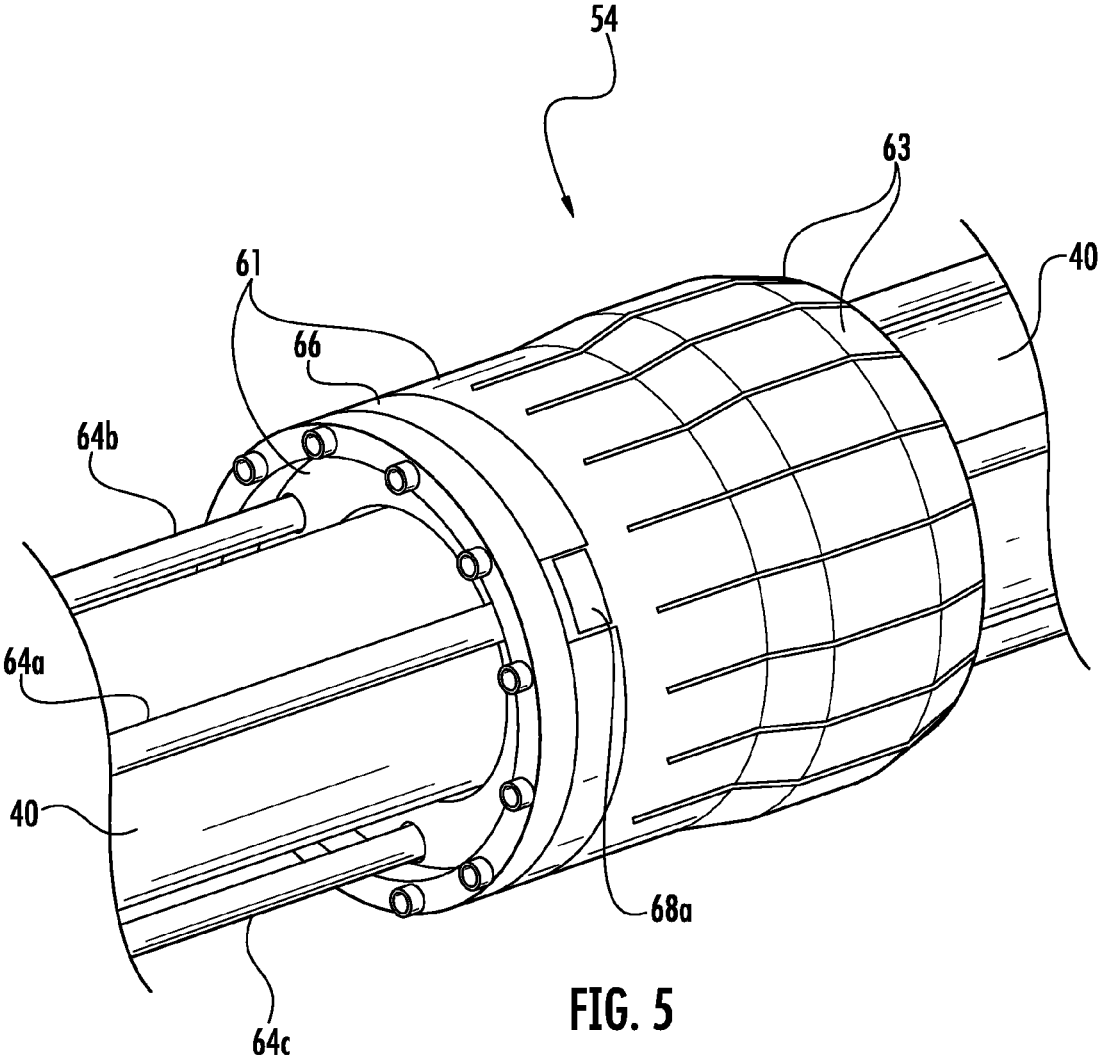
FIG. 5 is a greatly enlarged perspective view of a shorting plug of the adjustable balun of FIG. 3.
Figure 6:
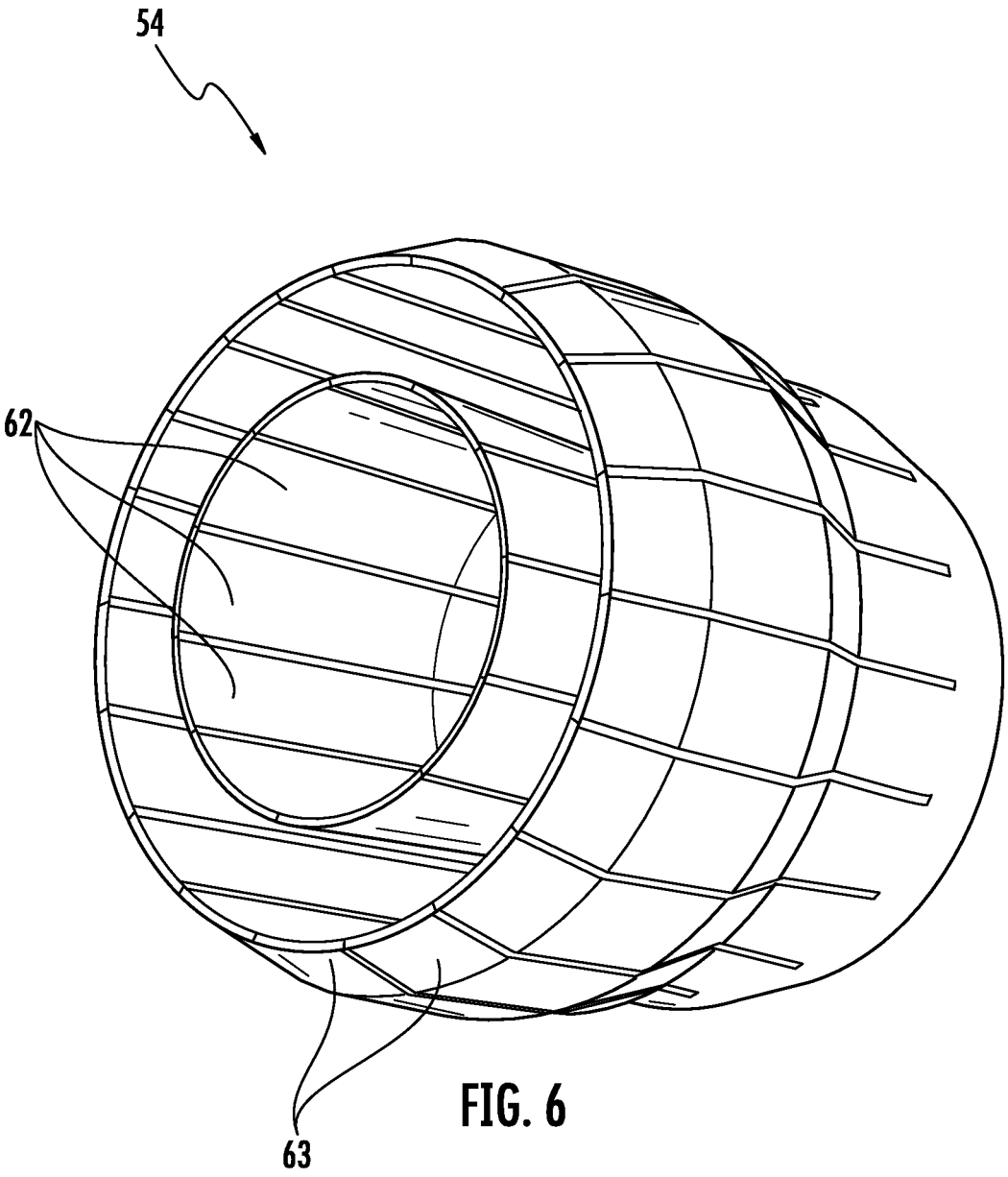
FIG. 6 is a greatly enlarged perspective view of a portion of the shorting plug of FIG. 3.

Referring initially to FIG. 1, an apparatus 30 for heating a hydrocarbon resource (e.g., oil sands, etc.) in a subterranean formation 32 having a wellbore 33 therein is described. In the illustrated example, the wellbore 33 is a laterally extending wellbore, although the system 30 may be used with vertical or other wellbores in different configurations. The system 30 further illustratively includes a radio frequency (RF) source 34 for an RF antenna or transducer 35 that is illustratively positioned in the wellbore 33 adjacent the hydrocarbon resource. The RF source 34 is positioned above the subterranean formation 32, and may be an RF power generator, for example. In an exemplary implementation, the laterally extending wellbore 33 may extend several hundred meters within the subterranean formation 32. Moreover, a typical laterally extending wellbore 33 may have a diameter of about fourteen inches or less, although larger wellbores may be used in some implementations. Although not shown, in some embodiments a second or producing wellbore may be used below the wellbore 33, such as would be found in a SAGD implementation, for collection of petroleum, etc., released from the subterranean formation 32 through heating.

An RF transmission line 38 extends within the wellbore 33 between the RF source 34 and the RF antenna 35. The RF transmission line 38 may include a plurality of separate segments which are successively coupled together as the RF antenna 35 is pushed or fed down the wellbore 33. The RF transmission line 38 is illustratively a coaxial transmission line that includes an inner tubular conductor 39 and an outer tubular conductor 40, which may be separated by a dielectric material, for example. A dielectric may also surround the outer tubular conductor 40, if desired. In some configurations, the inner tubular conductor 39 and the outer tubular conductor 40 may not be coaxial, although other transmission line conductor configurations may also be used in different embodiments.

The RF antenna 35 is coupled to the RF transmission line 38 adjacent a distal end of the wellbore 33. In particular, the RF antenna 35 may be a dipole antenna and may include first and second electrically conductive sleeves 41, 42. The first electrically conductive sleeve 41 surrounds the outer tubular conductor 40 of the RF transmission line 38. The outer tubular conductor 40 is coupled to the first electrically conductive sleeve 41 defining one leg of the dipole. The inner tubular conductor 39 extends outwardly beyond the first electrically conductive sleeve 41 and is coupled to the second electrically conductive sleeve 42 defining the second leg of the dipole.

With the RF antenna 35 being a dipole antenna, the RF source 34 may be used to differentially drive the RF antenna 35. That is, the RF antenna 35 may have a balanced design than may be driven from an unbalanced drive signal. Typical frequency range operation for a subterranean heating application may be in a range of about 100 kHz to 10 MHz, and at a power level of several megawatts, for example. However, it will be appreciated that other configurations and operating values may be used in different embodiments.

The apparatus 30 further illustratively includes an adjustable balun 45 coupled to the RF transmission line 38 adjacent the RF antenna 35 within the wellbore 33. Generally speaking, the adjustable balun 45 is used for common-mode suppression of currents that result from feeding the RF antenna 35, which may be particularly likely to occur when performing heavy oil recovery with an RF coaxial transmission line 38. More particularly, the adjustable balun 45 may be used to confine much of the current to the RF antenna 35, rather than allowing it to travel back up the outer tubular conductor 40 of the transmission line, to thereby help maintain volumetric heating in the desired location while enabling efficient, safe and electromagnetic interference (EMI) compliant operation.

Yet, implementation of a balun deep within a wellbore 33 adjacent the RF antenna 35 (e.g., several hundred meters down-hole), and without access once deployed, may be problematic for typical baluns. Variable operating frequency may be desirable to facilitate optimum power transfer from the RF antenna 35 to the subterranean formation 32, which changes over time with heating.

Referring additionally to FIGS. 2-6, the adjustable balun 45 illustratively includes a tubular balun housing 46 surrounding the coaxial RF transmission line 38, for example, for a length of 11 meters. Of course, the tubular balun housing 46 may be another length. The tubular balun housing 46 is adjacent the first electrically conductive sleeve 41 and is spaced therefrom by a dielectric spacer 43. The tubular balun housing 46 may be in the form of an electrically conductive tubular pipe or sleeve, and may be similar to the first electrically conductive sleeve 41. More particularly, the tubular balun housing 46 may serve as a cladding or protective outer housing for the RF transmission line 38, and typically includes a metal (e.g., steel, etc.) that is sufficiently rigid to allow the RF transmission line to be pushed down into the wellbore 33. A space 47 is defined between the tubular balun housing 46 and the RF transmission line 38.

Additionally, an adjustable shorting plug 54 is slidably moveable within the space 47. The adjustable shorting plug 54 contacts the tubular balun housing 46 and the outer conductor 40 of the RF transmission line 38 at an adjustable shorting position.

The adjustable shorting plug 54 illustratively includes a tubular body 61 and inner spring contacts 62 extending outwardly from the tubular body to contact the RF transmission line 38, and more particularly, the outer conductor 40. Outer spring contacts 63 extend outwardly from the tubular body 61. The outer spring contacts 63 are spaced from the inner spring contacts 62 to contact the tubular balun housing 46.

Three guide rods 64*a*-64*c* define a path of travel in the space 47 for the adjustable shorting plug 54. A pair of spaced apart end stops 65*a*, 65*b* is coupled to RF transmission line 38 adjacent respective ends of the guide rods 64*a*-64*c* defining endpoints of the path of travel.

The adjustable shorting plug 54 includes a ring 66 or guide bushing having three guide rod openings therein for the guide rods 64*a*-64*c* and defining three points of contact therewith. Respective fasteners 68*a*, which may be threaded fasteners, for example, floating nuts, are in respective guide rod openings. The guide rods 64*a*-64*c* may be threaded dielectric guide rods, for example, polyetherimide Acme threaded rods, and more particularly, Ultem® 2300 ⅜" Acme screws available from Saudi Basic Industries Corporation of Saudi Arabia. Indeed, while three guide rods 64*a*-64*c* are illustrated, it will be appreciated that a different number of guide rods may be used.

The adjustable balun 45 also includes an actuator in the form of an electric motor 71, configured to slidably move the adjustable shorting plug 54 within the space 47. For example, the electric motor 71 may be a 10 mm electric motor. However, other types of motors may be used. The electric motor 71, through a sync gear 72 and idlers 73*a*-73*e* coupled to one of the end stops 65*a*, rotates a sync gear ring 74 so that the guide rods 64*a*-64*c* rotate and advance the shorting plug 54 axially along the path of travel to the desired shorting position with a corresponding desired electrical performance. In some embodiments, the adjustable shorting plug 54 may slidably move along the path of travel via a pulley, belt, and/or other transport technique, as will be appreciated by those skilled in the art. A controller 44 may be coupled to the electric motor 71 to control operation of the adjustable shorting plug 54. The controller 44, which may be above the subterranean formation 32, may include measurement, control, and/or other circuitry as will be appreciated by those skilled in the art.

The adjustable balun 45 advantageously allows a mechanical sliding adjustment by moving the electrical contact or "short" in relative small increments to achieve desired performance characteristics. For example, an adjustable balun 45 with a 90-inch long path of travel or adjustment may achieve a frequency range of about 6.85 MHz to about 5.7 MHz, for example. Of course, the frequency range may be changed or affected based upon geometry of the antenna 35.

A method aspect is directed to a method of adjusting a balun for a radio frequency (RF) antenna assembly 30 to be positioned within a wellbore 33 in a subterranean formation 32 for hydrocarbon resource recovery. The method includes slidably moving the adjustable shorting plug 54 within the space 47 between a tubular balun housing 46 surrounding an RF transmission line 38.

The adjustable shorting plug 54 includes a tubular body 61, inner spring contacts 62 extending outwardly from the tubular body to contact the RF transmission line 38, and outer spring contacts 63 extending outwardly from the tubular body and spaced from the plurality of inner spring contacts to contact the tubular balun housing 46. The adjustable shorting plug 54 is slidably moved along a path of travel defined by guide rods 64*a*-64*c*. In particular, the actuator 71 may be operated to slidably move the adjustable shorting plug 54 within the space 47.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) antenna assembly configured to be positioned within a wellbore in a subterranean formation for hydrocarbon resource recovery, the RF antenna assembly comprising:

an RF transmission line;

an antenna coupled to said RF transmission line; and an adjustable balun comprising a tubular balun housing surrounding said RF transmission line and defining a space therebetween, and an adjustable shorting plug slidably movable within the space and contacting said tubular balun housing and said RF transmission line at an adjustable shorting position.

2. The RF antenna assembly of claim 1, wherein said adjustable shorting plug comprises:

a tubular body;

a plurality of inner spring contacts extending outwardly from said tubular body and configured so as to contact said RF transmission line; and a plurality of outer spring contacts extending outwardly from said tubular body and spaced from said plurality of inner spring contacts and configured so as to contact said tubular balun housing.

3. The RF antenna assembly of claim 1, wherein said adjustable balun further comprises a plurality of guide rods defining a path of travel in the space for said adjustable shorting plug.

4. The RF antenna assembly of claim 3, wherein said adjustable balun further comprises a pair of spaced apart end stops coupled to said RF transmission line adjacent respective ends of said plurality of guide rods to define endpoints of the path of travel.

5. The RF antenna assembly of claim 3, wherein said adjustable shorting plug comprises:

a ring having a plurality of guide rod openings therein for said plurality of guide rods; and a plurality of fasteners in respective guide rod openings.

6. The RF antenna assembly of claim 5, wherein said plurality of guide rods comprises a plurality of threaded guide rods; and wherein said plurality of fasteners comprises a plurality of threaded fasteners.

7. The RF antenna assembly of claim 1, wherein said adjustable balun further comprises an actuator configured to slidably move said adjustable shorting plug within the space.

8. The RF antenna assembly of claim 7, wherein said actuator comprises an electric motor.

9. The RF antenna assembly of claim 1, wherein said RF transmission line comprises a coaxial RF transmission line.

10. The RF antenna assembly of claim 1, further comprising an RF source coupled to said RE transmission line.

11. The RF antenna assembly of claim 1, wherein said antenna comprises a dipole antenna.

12. An adjustable balun for a radio frequency (RF) antenna assembly configured to be positioned within a wellbore in a subterranean formation for hydrocarbon resource recovery, the adjustable balun comprising:

a tubular balun housing surrounding an RF transmission line and configured so as to be coupled to an antenna and defining a space therebetween; and an adjustable shorting plug slidably movable within the space and configured so as to contact said tubular balun housing and said RF transmission line at an adjustable shorting position.

13. The adjustable balun of claim 12, wherein said adjustable shorting plug comprises:

a tubular body;

a plurality of inner spring contacts extending outwardly from said tubular body and configured so as to contact said RF transmission line; and a plurality of outer spring contacts extending outwardly from said tubular body and spaced from said plurality of inner spring contacts and configured so as to contact said tubular balun housing.

14. The adjustable balun of claim 12, further comprising a plurality of guide rods defining a path of travel in the space for said adjustable shorting plug.

15. The adjustable balun of claim 14, further comprising a pair of spaced apart end stops coupled to said RF transmission line adjacent respective ends of said plurality of guide rods to define endpoints of the path of travel.

16. The adjustable balun of claim 14, wherein said adjustable shorting plug comprises a ring having a plurality of guide rod openings therein for said plurality of guide rods and a plurality of fasteners in respective guide rod openings.

17. The adjustable balun of claim 12, further comprising an actuator configured to slidably move said adjustable shorting plug within the space.

* * * * *